US005325021A

United States Patent [19]

Duckworth et al.

[11] Patent Number: 5,325,021

[45] Date of Patent: Jun. 28, 1994

[54] RADIO-FREQUENCY POWERED GLOW DISCHARGE DEVICE AND METHOD WITH HIGH VOLTAGE INTERFACE

[75] Inventors: Douglas C. Duckworth, Knoxville, Tenn.; R. Kenneth Marcus, Clemson, S.C.; David L. Donohue, Vienna, Austria; Trousdale A. Lewis, Oak Ridge, Tenn.

[73] Assignee: Clemson University, Clemson, S.C.

[21] Appl. No.: 944,216

[22] Filed: Sep. 11, 1992

Related U.S. Application Data

[63] Continuation-in-part of Ser. No. 886,030, Apr. 9, 1992, abandoned.

[51] Int. Cl.[5] ..... H01J 7/24

[52] U.S. Cl. ..... 315/111.51; 315/176; 250/288; 250/281

[58] Field of Search ..... 250/288, 281; 315/221 R, 244, 163, 176, 111.21, 111.41, 111.81, 111.51

[56] References Cited

U.S. PATENT DOCUMENTS

| | | | |
|---|---|---|---|
| 3,626,234 | 12/1971 | Grimm . | |
| 3,876,305 | 4/1975 | Gough et al. . | |
| 4,501,965 | 2/1985 | Douglas . | |
| 4,634,867 | 1/1987 | Ottley et al. | 250/288 |
| 4,795,588 | 1/1989 | Hayes et al. | 315/111.51 |
| 4,812,040 | 3/1989 | Marcus et al. . | |
| 4,849,628 | 7/1989 | McLuckey et al. . | |
| 4,853,539 | 8/1989 | Hall et al. . | |
| 4,912,324 | 3/1990 | Clark et al. . | |
| 5,006,706 | 4/1991 | Marcus . | |
| 5,086,226 | 2/1992 | Marcus . | |

FOREIGN PATENT DOCUMENTS

| | | | |
|---|---|---|---|
| 2049876 | 3/1992 | Canada | 315/111.21 |
| 0296920 | 12/1988 | European Pat. Off. . | |
| 8710746 | 11/1987 | Fed. Rep. of Germany . | |
| 2616545 | 12/1988 | France . | |
| 0197873 | 10/1985 | Japan . | |
| 8706341 | 10/1987 | World Int. Prop. O. . | |

OTHER PUBLICATIONS

Analytical Chemistry, vol. 61, No. 17, Sep. 1989, pp. 1879-1886 by Duckworth et al. "RF Powered Glow (List continued on next page.)

*Primary Examiner*—Robert J. Pascal
*Assistant Examiner*—Arnold Kinkead
*Attorney, Agent, or Firm*—Dority & Manning

[57] ABSTRACT

A high voltage accelerating potential, which is supplied by a high voltage direct current power supply, is applied to the electrically conducting interior wall of an RF powered glow discharge cell. The RF power supply desirably is electrically grounded, and the conductor carrying the RF power to the sample held by the probe is desirably shielded completely excepting only the conductor's terminal point of contact with the sample. The high voltage DC accelerating potential is not supplied to the sample. A high voltage capacitance is electrically connected in series between the sample on the one hand and the RF power supply and an impedance matching network on the other hand. The high voltage capacitance isolates the high DC voltage from the RF electronics, while the RF potential is passed across the high voltage capacitance to the plasma. An inductor protects at least the RF power supply, and desirably the impedance matching network as well, from a short that might occur across the high voltage capacitance. The discharge cell and the probe which holds the sample are configured and disposed to prevent the probe's components, which are maintained at ground potential, from bridging between the relatively low vacuum region in communication with the glow discharge maintained within the cell on the one hand, and the relatively high vacuum region surrounding the probe and cell on the other hand. The probe and cell also are configured and disposed to prevent the probe's components from electrically shorting the cell's components.

19 Claims, 8 Drawing Sheets

OTHER PUBLICATIONS

Discharge Atomization/Ionization Source for Solids Mass Spectrometry.

Jl. of Applied Physics, vol. 45, #4, Apr. 1974, pp. 1779–1786 by Coburn et al. "Glow Discharge Mass Spectrometry Technique for Determining Elements Comp. Profiles in Solids".

Analytical Chemistry, vol. 47, #9, Aug. 1975, pp. 1528–1531 by Donohue et al. "Radio Frequency Cavity Ion Source in Solids Mass Spectrometry".

Niel Ketchell's 1989 Ph.D dissertation entitled "An Investigation of DC and RF Sputtering Glow Discharges for the Mass Spectrometric Analysis of Solids from the University of Manchester".

Analytical Chemistry, vol. 59, No. 19, Oct. 1987, pp. 2369–2373; R. K. Marcus et al: "Analysis of Geological Samples by Hollow Cathode Plume Atomic Emission Spectrometry".

FIG. 1
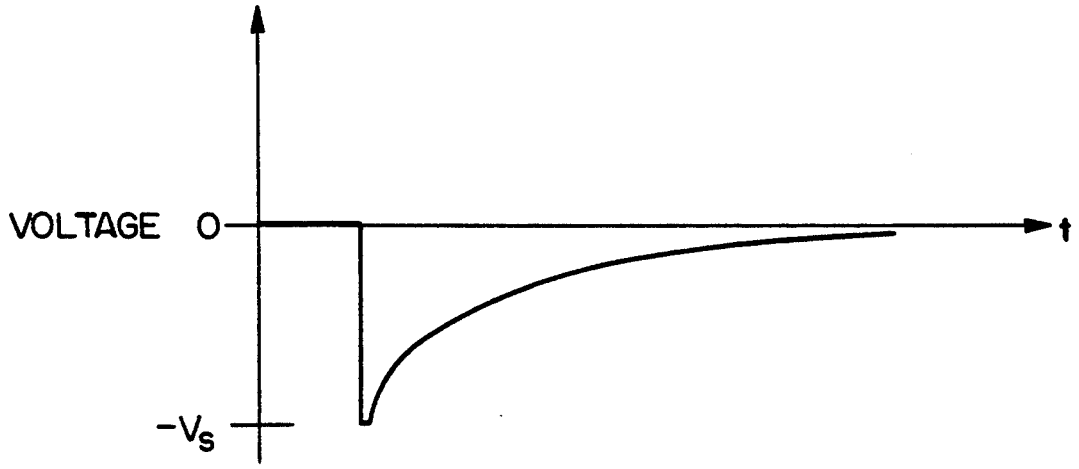
FIG. 2A
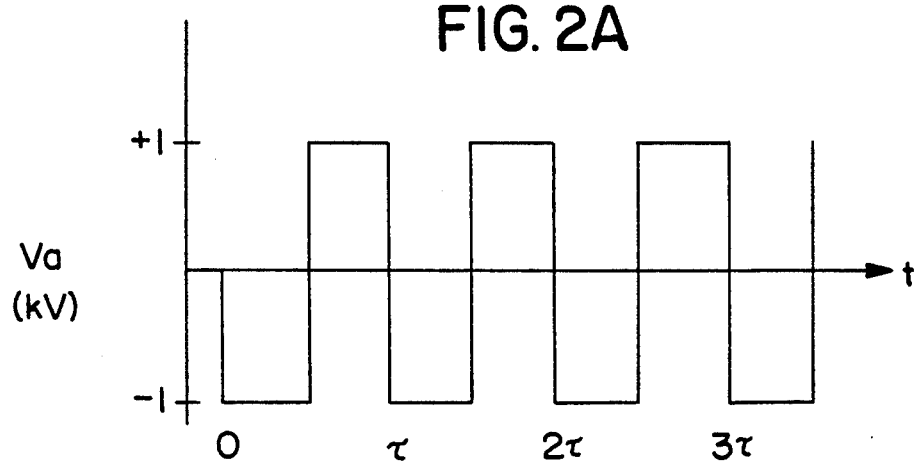
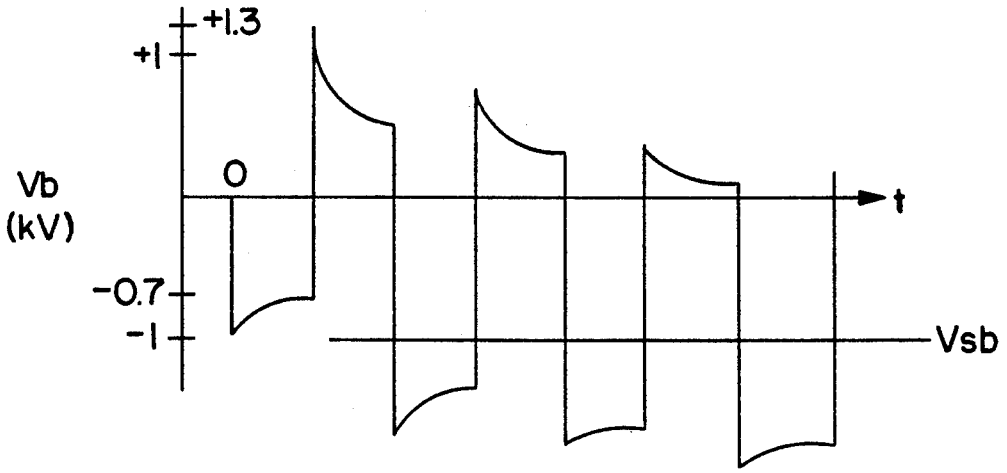
FIG. 2B

RADIO-FREQUENCY POWERED GLOW DISCHARGE DEVICE AND METHOD WITH HIGH VOLTAGE INTERFACE

This invention was made with United States Government support to Martin Marietta by the Department of Energy under Contract No. DE-AC05-840R21400, pursuant to which DOE Contract Martin Marietta awarded Contract Nos. AJ871GA1 and AH580GA1 to Clemson University, and thus the Government may have certain rights in the invention.

This is a continuation-in-part application to application Ser. No. 07/866,030 filed on Apr. 19, 1992, now abandoned.

BACKGROUND OF THE INVENTION

The present invention relates to a radio frequency (RF) powered glow discharge sputtering source for mass spectrometric analysis of non-conducting solids as well as metals, alloys, semiconductors and the like.

The application of conventional direct current (DC) powered glow discharge devices for the direct analysis of conductive solids such as metals, alloys and semiconductors is well known in the art and is discussed as background to the discussion of the RF powered glow discharge devices and methods. Generally, these DC powered glow discharge devices employ low pressure, inert atmosphere plasmas to initiate cathodic sputtering of solid samples that atomizes the sample material and produces a so-called "negative glow," also called a "glow discharge." In the negative glow, sputtered material collides with electrons and metastable discharge gas atoms to produce excited state atoms and ionic species. The electromagnetic radiation produced during the decays from excited energy states to lower energy states is responsible for the "glow" phenomenon.

In a so-called "diode" design of a DC powered glow discharge device, the conducting sample being analyzed takes the form of a cathode, which is housed in a vacuum chamber along with an anode sleeve. The walls of the vacuum chamber are electrically conducting and usually also act as an anode. The vacuum chamber is filled with an inert gas such as argon. When a sufficiently high electrical potential exists between the sample forming the cathode and the chamber walls and/or sleeve forming the anode, this causes the gas to dissociate into electrons and positively charged ions, which form part of what is sometimes called the "glow discharge" or the "negative glow." Much of this atomic dissociation occurs in a particular spatial region inside the vacuum chamber, and this region is sometimes called the "discharge excitation region" or the "negative glow region."

Since the sample is the negatively charged cathode of a DC powered glow discharge device, the negative field potential attracts the positively charged ions to the sample's surface. The so-called "sputtering" phenomenon occurs when the positively charged ions are accelerated toward the surface of the sample and eventually hit the cathode surface and dislodge atoms, ions and molecules of the cathode material. By virtue of the electrical biasing created by the electrical field inside the vacuum chamber, all of the negatively charged species (e.g., electrons, negative ions, and negatively charged molecules) will be accelerated away from the negatively biased cathode surface and all of the positively charged species in the vicinity will be accelerated to the cathode surface. The vast majority of sputtered particles are not charged and can either diffuse back to the cathode surface or into the discharge excitation region. The percentage of atoms entering the discharge excitation region is a function of the discharge pressure and cathode geometry.

In theory, the sputtering process acts as a cascade of inelastic collisions with the incoming ion imparting some portion of its kinetic energy, which approaches that of the electrical potential applied to the cathode, into the cathode material's lattice structure. According to this theory, if the sputtering ion has sufficient energy and directionality, the cascade will propagate back to the surface and result in the ejection of cathode material. The atoms ejected from the cathode material diffuse into the glow discharge region and become part of the so-called glow discharge. Sputter yields, the ratio of the average number of sputtered atoms to incident ions, are a function of the relative masses of the collision partners, the incident angle and energy of the sputtering ion, and the cathode material's binding energy.

DC powered glow discharge devices are currently employed to enable the sample to be subjected to elemental analysis by atomic absorption, atomic emission, atomic mass spectrometry, and a number of laser-based spectroscopic methods. These DC powered glow discharge devices, known commonly as "sources," have been limited by the fact that the sample must be conductive in nature so that it may act as a cathode in a conventional DC diode type design of the device. In an effort to analyze nonconducting solids without dissolution, nonconducting powder samples have been mixed with a conducting powder matrix. The resulting powder mixture is pressed into a disc sample, which, because of the conductive portion, allows for the required flow of current, but which also permits the sputtering of atoms of the nonconductive material upon impingement by a discharge ion. However, the mixing of the original sample with the conducting material introduces certain problems. For example, the dilutive effect of the conducting material results in both a loss of sensitivity and an increase in the likelihood of contamination. Moreover, many nonconducting solids are not easily transformed into powders, and the transformation of the solid into a powder precludes any depth resolved analyses.

The use of a radio frequency (RF) powered, as opposed to DC powered, glow discharge in argon to sputter and ionize a solid hollow cathode sample for analysis has been described (*Analytical Chemistry,* 47 (9), 1528, (1975). However, the hollow cathode geometry requires that the sample itself be machined into a cylinder. Machining the sample into a cylinder requires considerable labor and prevents depth profiling analysis.

The use of any glow discharge sampling geometry in which the sample must be inserted into the vacuum chamber, automatically restricts the size and shape of the sample to be analyzed. In such instances, metals and alloys must be machined to the proper geometry. Machining and grinding eliminate the possibility of performing depth-resolved analyses. Electrically nonconductive materials such as glasses and ceramics are often nonmachineable. Nonmachineable bulk solids must first be ground into a powder and then pressed to form a solid powder sample of compatible size and shape. Additionally, the combination of powdered nonconductive samples with a conducting material results in both a loss of sensitivity and an increase in the likelihood of contamination.

A Grimm-Type high frequency powered glow discharge device (such as disclosed in Dec. 16, 1988 French Publication No. 2 616 545), which mounts the sample outside the vacuum chamber, disposes the cathode between the sample and the anode, and thus runs the risk of contamination from sputtering of the cathode material.

In order to analyze the sample in a mass spectrometer, the ionized sputtered material from the glow discharge must be transported from within the vacuum chamber of the glow discharge cell to the mass spectrometer. In a DC powered glow discharge source, a high DC voltage is applied to the walls of the vacuum chamber of the glow discharge cell in order to accelerate the charged sputtered material into the mass spectrometer. However, when this conventional method of applying a high DC voltage to both the sample and the discharge cell walls is tried in a RF powered glow discharge device, it destroys the ability of the device to maintain an analytically useful glow discharge.

Moreover, the RF glow discharge apparatus disclosed in U.S. Pat. Nos. 5,006,706 and 5,086,226 to Marcus (commonly assigned to the owner of the present application) pertain to cells maintained at ground potential. Any attempt to raise all of the RF electronics (RF generator and impedance matching network) to the same high DC electrical potential as the vacuum chamber walls have required using an isolation transformer (such as proposed at column 8, lines 8–11 in U.S. Pat. No. 4,501,965 to Douglas). This fails to provide a satisfactory solution because it causes additional problems of high voltage hazard, inconvenience, and electronic noise. For example, maintaining the RF electronics at the typical high voltage applied to the discharge cell means that the laboratory workers are subjected to the potential hazards of a five to ten thousand volt shock. Precautions needed to avoid encountering such electrical shock result in practical inconveniences in the performance of the measurements on the sample. In addition, it becomes impossible to shield the mass spectrometer system electronics adequately from RF electronic noise. Such electronic noise poses detriments to the desired limits of detection, experimental precision, and instrument calibration. Such noise also adversely affects the operation of other electronic instrumentation in the vicinity of the RF electronics because of the propagation of radio waves through this space.

OBJECTS AND SUMMARY OF THE INVENTION

It is a principal object of the present invention to provide a novel RF powered apparatus and method that operates on a solid material of any shape or electrical conductivity and presents same for direct analysis by mass spectrometry.

It is a further principal object of the present invention to provide a novel apparatus and method employing RF powered glow discharges to atomize solid samples for direct analysis by mass spectrometry without the hazards of maintaining the RF electronics at high voltages.

It is another principal object of the present invention to provide a novel apparatus and method employing RF powered glow discharges to atomize solid samples for direct analysis by mass spectrometry without subjecting the RF electronics or other electronic equipment in the vicinity of the RF electronics, to detrimental levels of electronic noise.

It is still another object of the present invention to provide such an apparatus which provides for the fast, successive analysis of a plurality of samples.

Yet another object of the present invention is to provide an apparatus and method for atomizing solid samples for analysis regardless of the electrical conductivity of the sample and without the need for such modifications of the sample as machining, dissolving, pulverizing, pressing or molding.

A further object of the present invention is to provide an apparatus and method for atomizing solid samples for analysis without having to insert the sample into the chamber where the glow discharge plasma is formed.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an RF power supply can be used to generate the glow discharge for a conventional mass spectrometer with a conventional arrangement for applying an accelerating potential to the ions produced in the glow discharge generated from the sample to be analyzed. This includes magnetic sector mass spectrometers, time-of-flight mass spectrometers, and other mass spectrometers which employ the exit slit as a high voltage repeller electrode. A high voltage accelerating potential, which is supplied by a high voltage direct current power supply, is applied to the electrically conducting interior wall of the discharge cell in order to be able to repel the positive ions formed in the discharge. However, the high voltage DC accelerating potential is not supplied to the sample. A capacitive matching network is used to match the impedance of the plasma inside the discharge cell to the impedance of the RF power supply circuit, which includes an RF power supply. In addition, the invention includes a high voltage capacitance electrically connected in series between the sample on the one hand and the RF power supply and impedance matching network on the other hand. The high voltage capacitance isolates the high DC voltage from the RF electronics, while the RF potential is passed across the high voltage capacitance to the plasma. The RF power supply desirably is electrically grounded, and the conductor carrying the RF power to the sample is desirably shielded completely excepting only the conductor's terminal point of contact with the sample.

In further accordance with the present invention, an inductor is added in the circuit in a manner that protects at least the RF power supply, and desirably the impedance matching network as well, from a short that might occur across the high voltage capacitance.

In yet further accordance with the present invention, an inductor is electrically connected in series between the discharge cell walls and the source of the direct current accelerating potential used to remove ions from the cell for use by the mass spectrometer. In addition, one end of a capacitor is electrically connected between this inductor and this DC high voltage source, while the other end of the capacitor is electrically connected to ground. This inductor and capacitor aid in isolating the accelerating potential from the RF power source.

In still further accordance with the present invention, the probe and cell are configured and disposed to prevent the components of the probe maintained at ground potential from shorting the cell components maintained at relatively high voltages on the order of 1 to 10 kilovolts.

In yet further accordance with an embodiment of the present invention, the probe and cell are configured and disposed to prevent the components of the probe maintained at ground potential from bridging between the relatively low vacuum region in communication with the glow discharge maintained within the cell and the relatively high vacuum region surrounding the probe and cell.

The accompanying drawings, which are incorporated in and constitute a part of this specification, illustrate one embodiment of the invention and, together with the description, serve to explain the principles of the invention.

BRIEF DESCRIPTION OF THE DRAWINGS

FIG. 1 is a graphical representation of the effect of the application of a high voltage pulse to an insulating surface;

FIG. 2A is a graphical representation of a 2 kV peak-to-peak square wave electrical potential provided by a power supply;

FIG. 2B is a graphical representation of the effect of the application of the 2 kV peak-to-peak square wave electrical potential of FIG. 2A to a pair of electrodes of a glow discharge device;

DETAILED DESCRIPTION OF THE PREFERRED EMBODIMENTS

Figure 3:
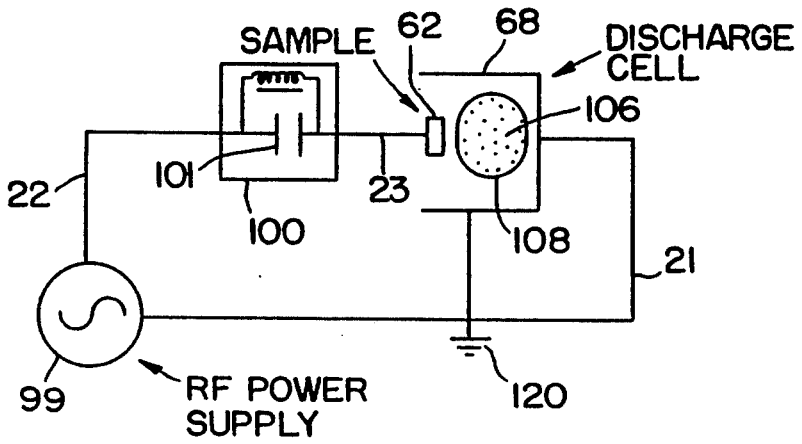
FIG. 3 PRIOR ART
FIG. 3 is a schematic diagram of a conventional RF powered glow discharge source.

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. In the FIGS., the same components are numbered consistently throughout the drawings.

(Because the electrode defined by the electrically conducting wall 68 of the discharge cell is maintained at the opposite electrical polarity to the electrical polarity of a sample 62 to be analyzed, the electrode formed by wall 68 of the discharge cell is sometimes referred to as the counterelectrode.) Although no distinctly defined ground exists in the RF discharge apparatus of the present invention, sample 62 is often referred to as the cathode by analogy to the DC discharge apparatus. This convention is used in the present description.

As noted above, one of the factors which has tended to limit the application of glow discharges has been the requirement that the sample be conductive in nature. Conventional DC powered glow discharge devices cannot be used for the sputtering of purely nonconductive material, because in a DC system, if one of the electrodes in the system is an electrically insulating material, the required flow of current cannot occur.

However, the application of a high voltage electrical pulse to the surface of an article formed of material that is electrically insulating, can be considered analogous to the charging of a capacitor. In FIG. 1, the vertical axis represents the voltage (V) at the surface of an article formed of material that is electrically insulating, and the horizontal axis represents the time (t) at which this surface voltage is measured. As shown in FIG. 1, as a high negative (represented by the minus sign [−]) voltage of magnitude $V_s$ is applied to the surface of an article formed of material that is electrically insulating, the electrical potential of this surface initially drops instantaneously to $-V_s$ and then gradually charges to more positive electrical potentials as a function of time. This gradual positive charging behavior is not due to the accumulation of positive charges at the surface of the electrically insulating material but rather is due to the loss of electrons through ion neutralization reactions at the material's surface. As explained below, the time scale of this process is such that the application of voltage pulses at frequencies on the order of one megahertz (MHz) and above results in a pseudo-continuous residual negative electrical potential at the surface of the article formed of electrically insulating material.

As explained in column 7 of U.S. Pat. No. 5,086,226 to Marcus, which patent is hereby incorporated herein by reference, a key aspect of the application of a RF powered glow discharge to the sputtering of a surface of the sample to be analyzed, is the "self-biasing" electrical potential which exists between the electrodes which generate the plasma. For example, FIG. 2 schematically illustrates the application of a 2 kilovolt (kV) peak-to-peak square wave potential (Va) by an RF power supply to a pair of electrodes. FIG. 2A schematically represents an output of a 2 kilovolt (kV) peak-to-peak square wave potential (Va) generated by an RF power supply to a pair of electrodes. FIG. 2B schematically represents the voltage of an insulating sample to which this voltage from FIG. 2A has been applied. As shown in FIG. 2B, at the very beginning (at time t=0) of the initial half-cycle, the voltage (Vb) of the primary cathode goes to −1 kV and then begins positive charging over time (t) to approximately −0.7 kV. As the applied voltage Va is switched to +1 kV, a surface potential of +1.3 kV is produced. During this half-cycle, electrons are accelerated to the electrode's surface. The greater mobility of the plasma electrons (compared to the much heavier positive ions) results in a faster surface neutralization during this-half-cycle such that the electrode's surface potential approaches zero much faster than the previous half-cycle and thus reaching a value of +0.2 kV. When the voltage polarity is switched to the start of the second full cycle, the potential on this electrode will reach −1.8 kV (+0.2–2 kV). As successive cycles proceed, the wave form of Vb will reach a constant offset value which is significantly displaced in the negative direction. This constant negative voltage component is known as the "self-biasing" potential Vsb and is for all intents and purposes continuous. The magnitude of the self-biasing potential Vsb generally has an approximate value of one-half of the applied peak-to-peak potential (the applied peak-to-peak potential is 2×Va in the example shown in FIGS. 2A and 2B). The electrode is bombarded alternately by high energy ions and low energy electrons and is, therefore, employed as the sputtering target (cathode). While the potentials supplied to the electrodes are alternating, a time averaged cathode and anode are established. As discussed in U.S. Pat. No. 5,086,226 to Marcus, self-biasing is also a function of the respective electrode sizes. Thus, it is preferable to apply the RF potential to the sputtering target and to make its exposed area much smaller than the vacuum chamber anode, which is usually held at ground potential.

The present invention provides means for modifying a conventional mass spectrometer such as shown for example in U.S. Pat. No. 4,853,539 to Hall et al (the disclosure of which patent is hereby incorporated herein by this reference), U.S. Pat. No. 4,912,324 to Clark et al (the disclosure of which patent is hereby incorporated herein by this reference), or the VG 9000 TM (commercially available from Fisons Instruments, VG Elemental, Winsford, Chesire, ENGLAND), by replacing the direct current (DC) powered glow discharge with a radio frequency (RF) powered glow discharge having a high voltage interface.

FIG. 3 schematically illustrates an RF powered glow discharge apparatus such as discussed in U.S. Pat. No. 5,006,706 to Marcus (the disclosure of which patent is hereby incorporated herein by this reference). This is a so-called ground potential arrangement, because as is schematically represented by the numeral 120, the discharge cell is maintained at ground electrical potential along with the RF electronics. A first electrical lead 21 connects an RF power supply to electrically conducting walls 68 of the discharge cell in which a glow discharge plasma 106 is to be generated from a sample 62 to be analyzed. In order to achieve efficient energy transfer to the plasma 106, an impedance matching network 100 is incorporated electrically in series with the RF generator 99 via a second lead 22. A third lead 23 electrically connects impedance matching network 100 in series with sample 62. As schematically shown in FIG. 3, matching network 100 desirably is an LC circuit which is tuned such that the total impedance of matching network 100 and plasma 106 equals the output impedance of the RF generator 99.

Figure 4:
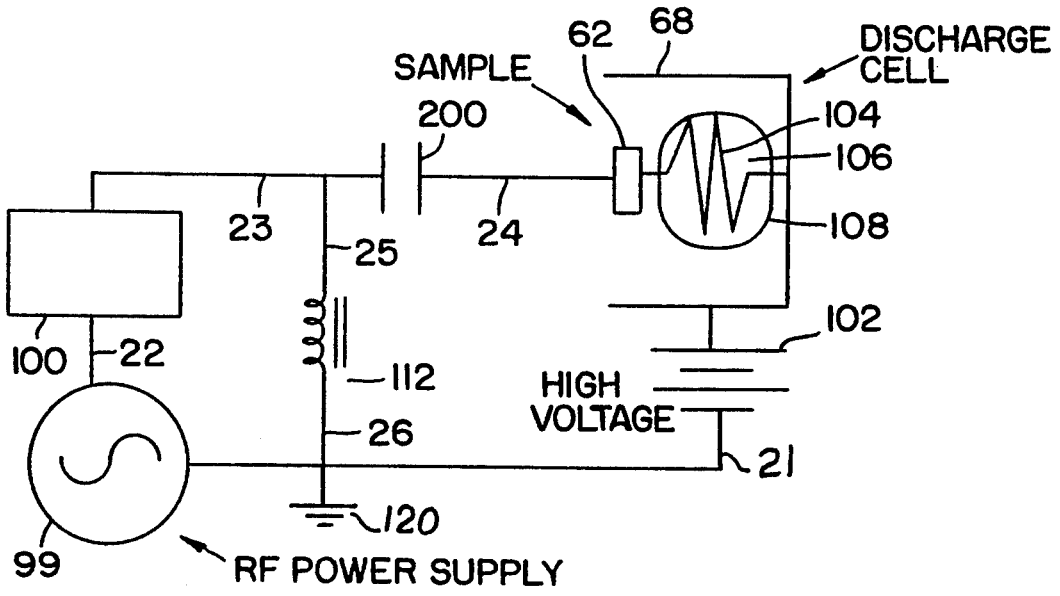
FIG. 4 is a schematic representation of an embodiment of the present invention.

As schematically shown in FIG. 3, matching network 100 should employ a capacitive coupling, such as a high voltage blocking capacitor 101 connected in series with the RF generator 99, to prevent any net current from flowing through the electrode circuit formed by sample 62, cell walls 68 and plasma 106 (the latter being schematically represented in FIG. 4 as an internal resistance 104). It should be noted that if the glow discharge is directly coupled (i.e., no blocking capacitor is interposed between the sample and one of the presently available RF generators), bias potentials are not allowed to develop for an electrically conducting sample, since the bias potentials would be continuously compensated by electron flow through the electrode circuit. Thus, a capacitive matching network connected in series between the cathode and the RF power supply is essential when using one of the presently available RF power sources to generate the glow discharge for an electrically conducting sample. A suitable RF generator 99 and matching network 100 are a model RF5S and a model AM-5, respectively, available from RF Plasma Products, Inc., of Marlton, N.J. A driving potential provided by RF generator 99 desirably is unmodulated at frequencies above one megahertz, and 13.56 megahertz has been used with success. The RF generator desirably should be able to maintain the nonconducting sample at a potential of at least 300 volts at one megahertz. The waveform can be of any shape, including sinusoidal, square, triangular, etc. The RF generator 99 desirably should be able to supply power over a range of from zero to 1,000 watts. The optimum power for any given sample, depends in large measure on the type of material forming the sample.

In the case of a mass spectrometer that incorporates a magnetic sector analyzer such as illustrated in FIG. 1 of U.S. Pat. No. 4,853,539 to Hall et al, the extraction of the ions from the ion source is achieved by an electrostatic field maintained between the body of the glow discharge source and an apertured (or slitted) electrode that is disposed between the source and the entrance to a flight tube as in a conventional mass spectrometer. This electrostatic field is the accelerating potential that moves the ions from the source into the flight tube leading to the conventional mass spectrometer. The accelerating potential is created by maintaining the apertured electrode in the wall of the discharge cell at the accelerating potential of the spectrometer. Consequently, the power supply for the glow discharge source as well as the associated electronics for the power supply, must be capable of safe operation at that accelerating potential, which typically is about 10,000 volts above ground potential.

However, the Hall et al arrangement for the mass spectrometer requires use of a direct current power supply glow discharge cell as the source. If one were to substitute an RF power supply for the DC power supply in the Hall et al arrangement in the absence of the present invention, the high voltage direct current accelerating potential would result in an equalization of the DC bias potential (Vsb schematically shown in FIG. 2B) which develops between the sample and the discharge cell. Such equalization results in an electrical short which distributes the RF-induced bias potential equally between the two electrodes, namely, the sample 62 and the discharge cell walls 68. Such removal of the self-biasing electrical potential between the electrodes prevents the sputtering phenomenon needed for formation of an adequate glow discharge for analyzing the sample.

In accordance with the present invention, an RF power supply can be used to generate the glow discharge source for a conventional mass spectrometer with a conventional arrangement for applying an accelerating potential to the ions produced in the glow discharge generated from the sample to be analyzed. As shown in FIG. 4 for example, a high voltage accelerating potential, which is supplied by a high voltage direct current power supply schematically represented by the symbol designated 102, must be supplied to the electrically conducting discharge cell wall 68 in order to be able to repel the positive ions formed in the glow discharge. A direct current transformer can supply the high voltage direct current power and thus provide the means for applying a preselected high direct current voltage to the counterelectrode formed by cell walls 68, which form the enclosure that defines the vacuum chamber in which the low vacuum containing argon or another inert gas is introduced.

Figure 5A:
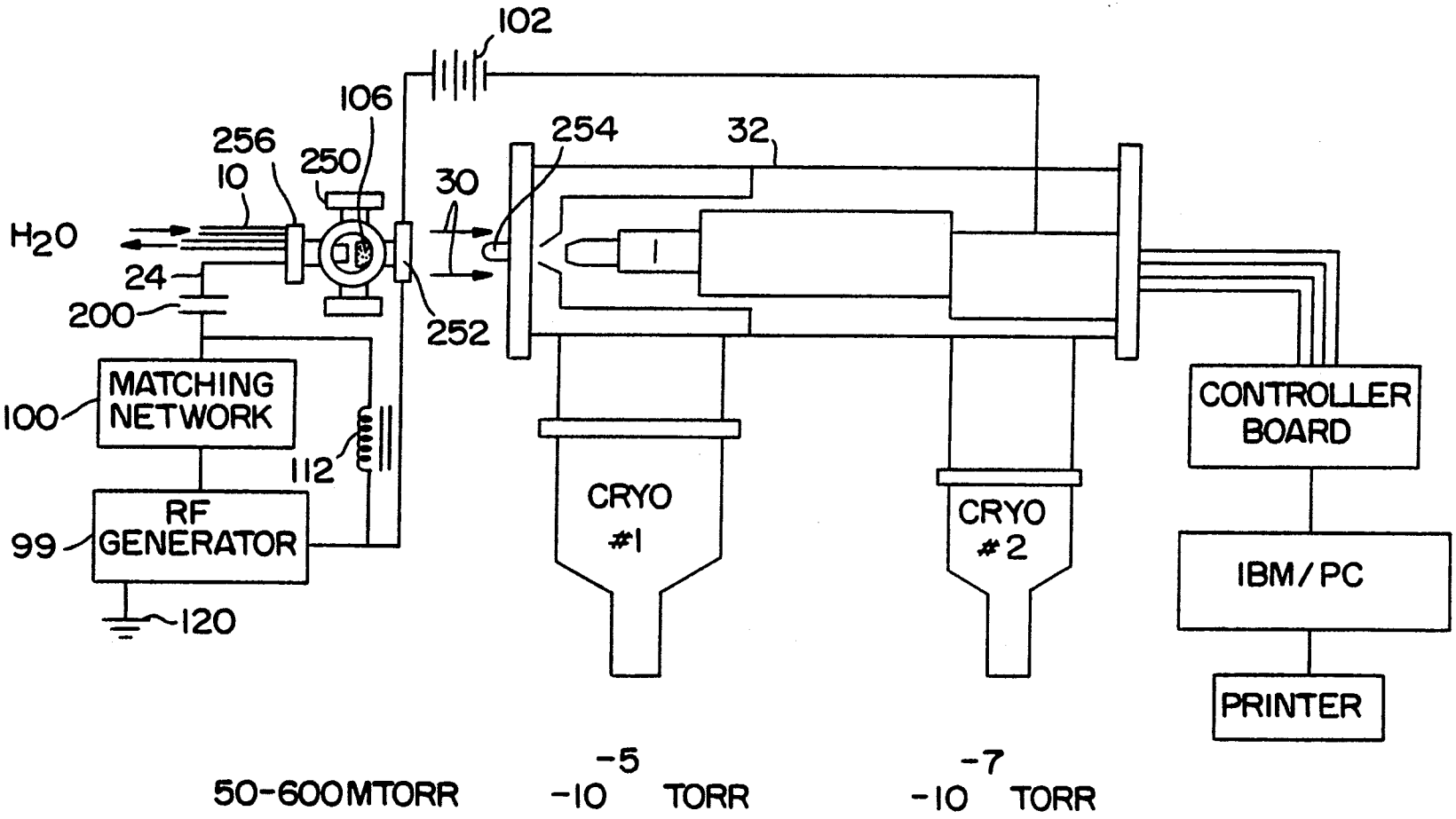
FIG. 5A is a schematic representation of a preferred embodiment of the present invention.
Figure 5B:
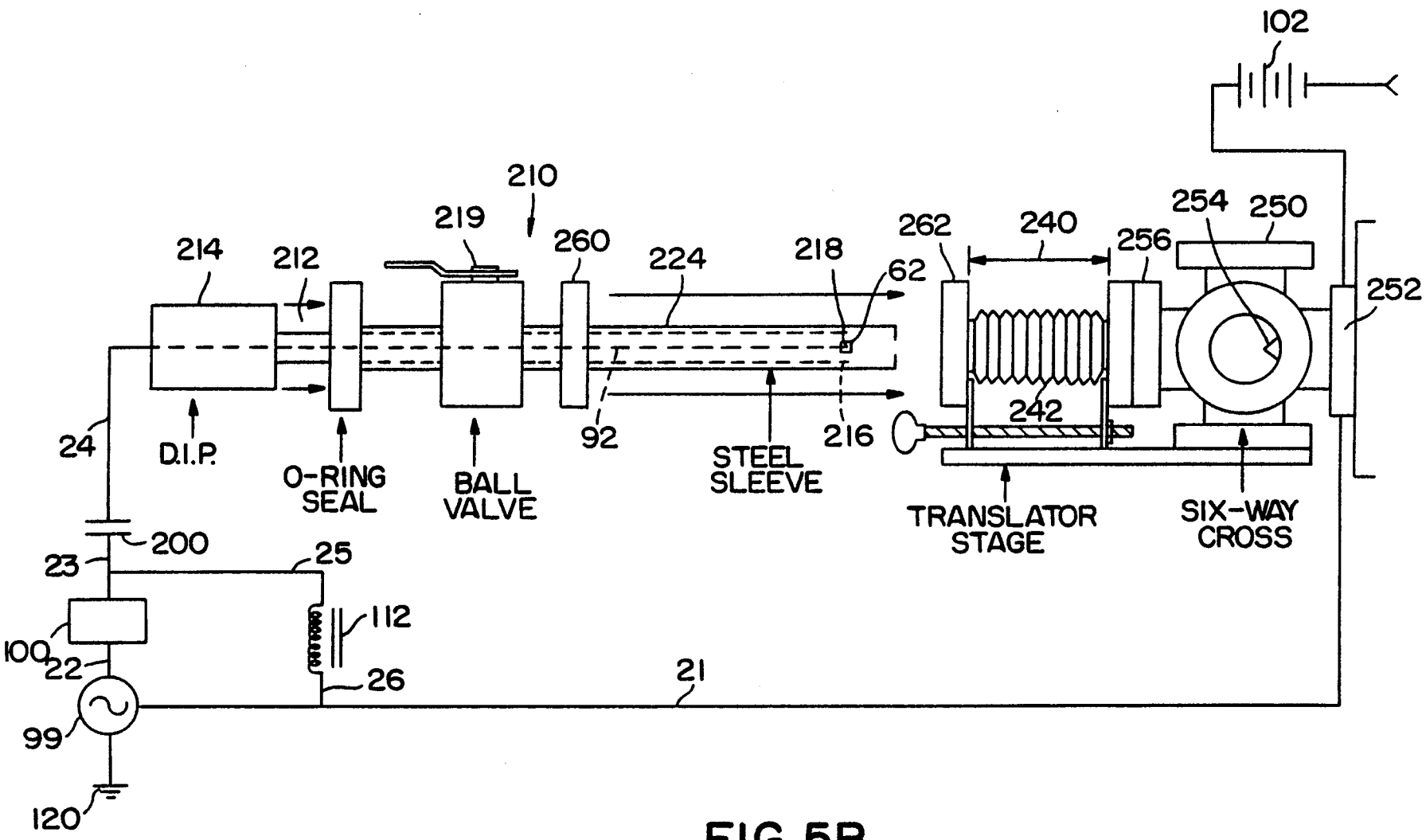
FIG. 5B is a schematic diagram of embodiments of components for use in the present invention.

In accordance with the present invention, the high voltage DC accelerating potential provided by direct current high voltage source 102 is supplied solely to the discharge cell wall 68. As shown in FIGS. 4, 5A and 5B according to the invention, the high voltage DC accelerating potential is not supplied to the sample 62. The inventors have found that the sample 62 is subsequently charged up by the direct current power source 102 applying high direct current voltage on the discharge cell. As schematically illustrated in FIG. 4 for example, the charging occurs through the internal resistance (schematically represented by the jagged line designated 104) of the plasma 106 (the boundary of the plasma 106 being schematically represented by the closed oval line designated 108) inside the discharge cell. As illustrated schematically in FIG. 4, this plasma 106 is an electrically conducting medium with a finite resistance 104.

Moreover, in further accordance with the present invention, a means is provided for matching the impedance of the glow discharge plasma 106 to the impedance of the RF power supply circuit. As shown in FIGS. 4 and 5 for example, a matching network 100 is used to match the impedance of the plasma 106 to the impedance of the RF power supply circuit.

In still further accordance with the present invention, a means is provided for blocking direct current from flowing back-and-forth between the impedance matching means and introducing an isolating high voltage capacitance electrically in series between the impedance matching means and the sample to be analyzed. As embodied herein and schematically shown in FIG. 4 .for example, the isolating capacitance means includes a blocking capacitor 200 electrically disposed in the RF circuit in order to sustain a DC bias on the surface of the sample 62 to be analyzed by a mass spectrometer (not shown in FIG. 4 but shown in FIG. 5A as generally 32) that uses a high voltage accelerating potential. As schematically shown in FIG. 4 for example, high voltage capacitor 200 is electrically connected in series via a fourth lead 24 to the sample 62. Leads 22, 23, and 24 desirably are formed as RF coaxial cable so that the conductor carrying the RF voltage is electrically shielded. High voltage capacitor 200 is electrically connected in series between the sample 62 on the one hand and the RF power circuit 99 and impedance matching network 100 on the other hand. The RF power circuit 99 desirably is electrically grounded, as indicated schematically by the symbol designated 120. The high voltage capacitor 200 isolates the high DC voltage from the RF electronics, while the RF potential is passed across the capacitor 200 to the plasma 106.

In further accordance with the present invention and as shown schematically in FIGS. 4, 5A, 5B, and 8 for example, an inductance 112 is added in the circuit in a manner that protects at least the RF power supply 99, and desirably the impedance matching network 100 as well, from a short that might occur across the high voltage capacitor 200. As shown schematically in FIG. 4 for example, a fifth lead 25 connects inductance, such as a choke coil 112, to third lead 23, and a sixth lead 26 connects choke coil 112 to first lead 21.

Electronic components simulating the electrical characteristics of any of the RF power supply, capacitances, inductances, and impedances can be used without departing from the invention.

FIG. 5A is a diagrammatic representation of an embodiment of the apparatus of the present invention as assembled for analysis with a conventional mass spectrometer. The apparatus which holds and presents the sample inside the vacuum chamber of six-way cross 250 for generating the glow discharge ion source for the mass spectrometer (indicated generally at 32) is generally indicated by the numeral 10 and is mounted coaxially with the axis of the mass spectrometer. Apparatus 10 also provides a means for electrically connecting the RF potential generated by RF generator 99 to the sample to be analyzed. The walls of six-way cross 250 define the electrically conducting counterelectrode of the glow discharge source. Port 256 of the six-way cross cooperates with apparatus 10 to provide a means for disposing the sample relative to the counterelectrode such that application of the appropriate RF potential between the sample and the counterelectrode in the presence of an inert gas, forms a sustainable glow discharge.

The ports of the six-way cross 250 other than the port 256 used to mount or receive the sample and the port 252 connecting the source to the ion extraction interface of the mass spectrometer, are utilized for the mounting of fused silica optical windows, vacuum and gas inlet attachments, and pressure monitoring thermocouples. The arrows 30 in FIG. 5A schematically indicate that connecting port 252 of cross 250 is to be connected to the mass spectrometer instrument as shown in FIG. 5B wherein ion sampling cone 254 is shown inserted into the vacuum .chamber of six-way cross 250.

As shown in FIG. 5A, a high direct current voltage source 102 applies an accelerating potential to the ions generated in the glow discharge region 106 that have diffused outwardly from the relatively higher pressure region inside the discharge cell. High direct current voltage source 102 thereby accelerates the positive ions exiting the vacuum chamber inside cross 250 and passes them through an intermediate vacuum region and into the analyzer region 32 for analysis. The DC high voltage power source 102 applies the accelerating potential which renders the cell walls at a positive electric potential of about 1,000 to 10,000 volts. The DC high voltage accelerating potential placed on the discharge cell requires the high voltage capacitor 200 to be placed in series with the sample 62 in order to isolate the resulting extremely positive electrical potential of the sample 62 from the RF power supply 99 and from the matching network 100. The high voltage capacitor 200 isolates the matching network 100 and the RF power supply 99 from the high direct current voltage applied to the discharge cell by the source 102 of direct current potential. Capacitor 200 blocks the direct current voltage from reaching the impedance matching network and RF power supply. The inductance 112 prevents rapid voltage fluctuations in the RF circuit and acts as a choke coil.

A preferred embodiment of means for electrically connecting a radio frequency electromagnetic potential between the counterelectrode, which is exposed to the interior of the vacuum chamber, and the sample, can employ a direct insertion probe. The probe provides means for electrically connecting to the sample, the radio frequency electromagnetic potential generated by an RF generator. As embodied herein and shown schematically in FIG. 5B for example, further details of preferred components forming the arrangement generally indicated at 10 in FIG. 5A are schematically illustrated in FIG. 5B wherein ion sampling cone 254 is shown inserted into the vacuum chamber of six-way cross 250 via connecting port 252.

In particular, FIG. 5B schematically illustrates a preferred embodiment of a sample holder and sleeve assembly in the form of a direct insertion probe (DIP) for use with the present invention. The direct insertion probe is generally designated by the number 210 and mates with six-way cross 250 through a translator stage 240. Adaptor flange 260 allows ball valve 219 to be connected to translator stage 240 via mating flange 262. An electrically conducting and grounded probe body 212 is provided for shielding conductor rod 92, which carries the RF potential, and has one end mounted onto the coaxial connector base 214 of probe 210. A small sample 62 to be analyzed is mounted within a recess 218 of an electrically conducting sample holder body 216, which acts as the cathode by being electrically connected to the conductor rod 92 that is electrically shielded within probe body 212. The electrical shielding continues in the form of an electrically grounded steel sleeve that forms a grounded anode cap 224 which is drawn over the sample holder body 216. The anode cap 224 is within one dark space from the cathode 216 to preclude discharge therein. Translator stage 240 includes a bellows 242 in conjunction with a ball valve 219 and serves as a vacuum interlock that allows for insertion and withdrawal of probe 210 without adjustment of the argon pressure within the six-way cross vacuum chambers thereby permitting faster analysis of a series of samples. Thus, a series of probes 210 may be provided such that numerous samples 62 can be prepared for a fast, easy analysis of a batch of materials. As shown in FIG. 5B of the present application, the RF generator, impedance matching network 100, high direct current power supply 102 for the accelerating potential, high voltage capacitance 200, and choke coil 112 are configured and arranged as above-described for FIG. 4 and 5A.

Figure 5C:
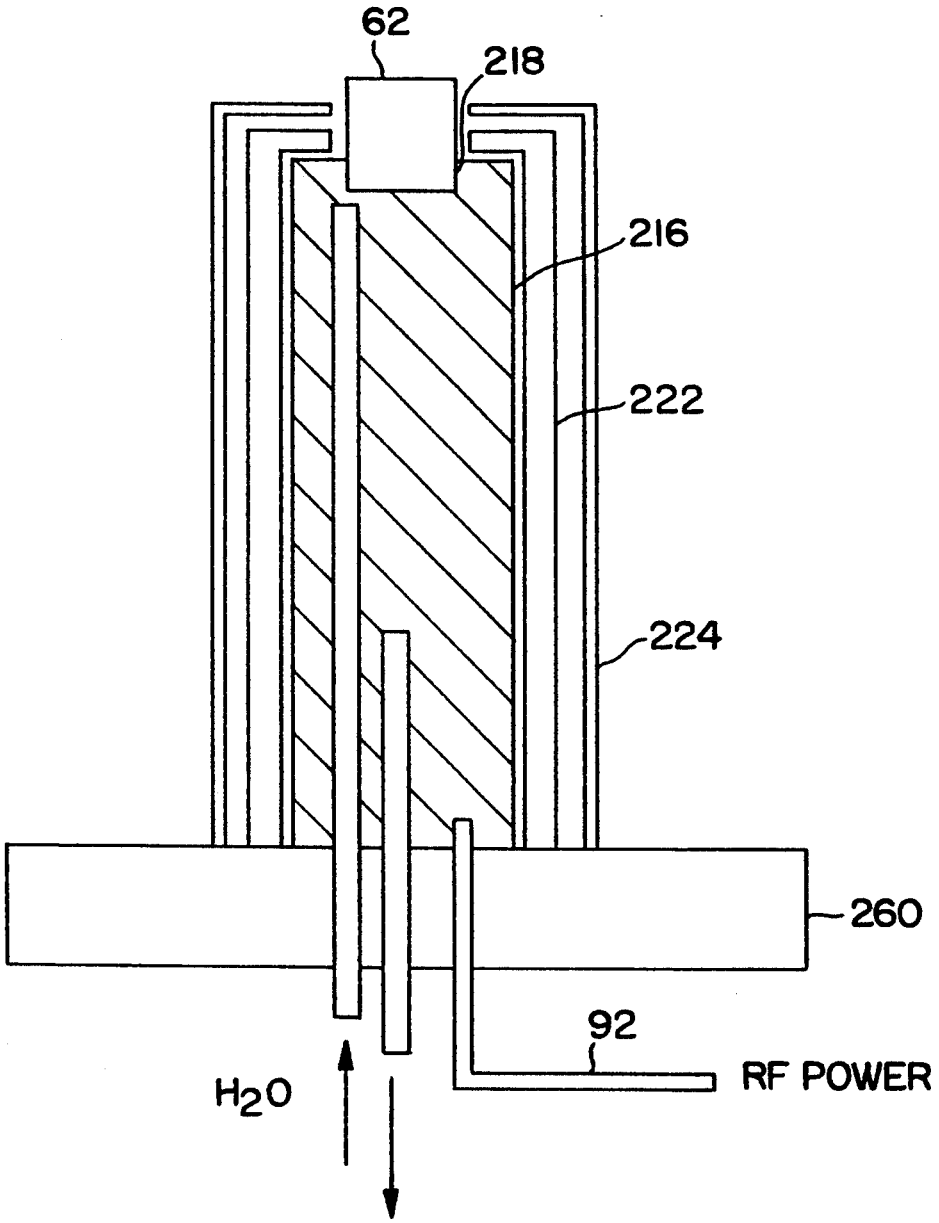
FIG. 5C is a schematic diagram of embodiments of components for use in the present invention.

Moreover, as schematically shown in detail in FIG. 5C for example, components carrying the RF power to the sample 62 desirably are completely shielded, electrically, upstream of the sample. Conductor 92 and cathode 216 carry the RF power to the sample 62. Thus, electrically conducting steel sleeve 224 coaxially shields cathode 216 excepting only the terminal point of contact with the sample 62 at recess 218 of cathode 216. Sleeve 224 is electrically connected to the electrically conducting and grounded shielding of the coaxial cable carrying the RF power to probe 210. Thus, in accordance with the present invention, the conductors carrying the RF power to the sample are completely electrically shielded upstream of the sample and thereby avoid the problems associated with an arrangement such as shown in FIG. 2 of U.S. Pat. No. 4,853,539 to Hall et al with its unshielded contact spring 27.

In yet further accordance with the present invention, the RF powered glow discharge high voltage interface of the present invention can be used in converting a conventional VG 9000 TM mass spectrometer into an instrument that has a capability of analyzing both conducting and nonconducting species. Moreover, the high voltage capacitor 409 (FIG. 8) electrically connected in series between the sample 462 and the RF electronics (the RF electronics includes the impedance matching network) provides the VG 9000 TM mass spectrometer with dramatically improved performance. In addition, as shown in FIGS. 5B, and 6–8 for example, the present invention alleviates much of the RF noise by shielding the electrically conducting components which carry the RF power to the sample to be analyzed. This improves detection limits and prevents such noise from influencing the calibration of the mass spectrometer. For example, when compared to attempts to float the RF generator in a conventional VG 9000 TM mass spectrometer system at the high voltage accelerating potential, the present invention has improved signal-to-noise ratios by a factor of approximately 1,000.

Figure 6:
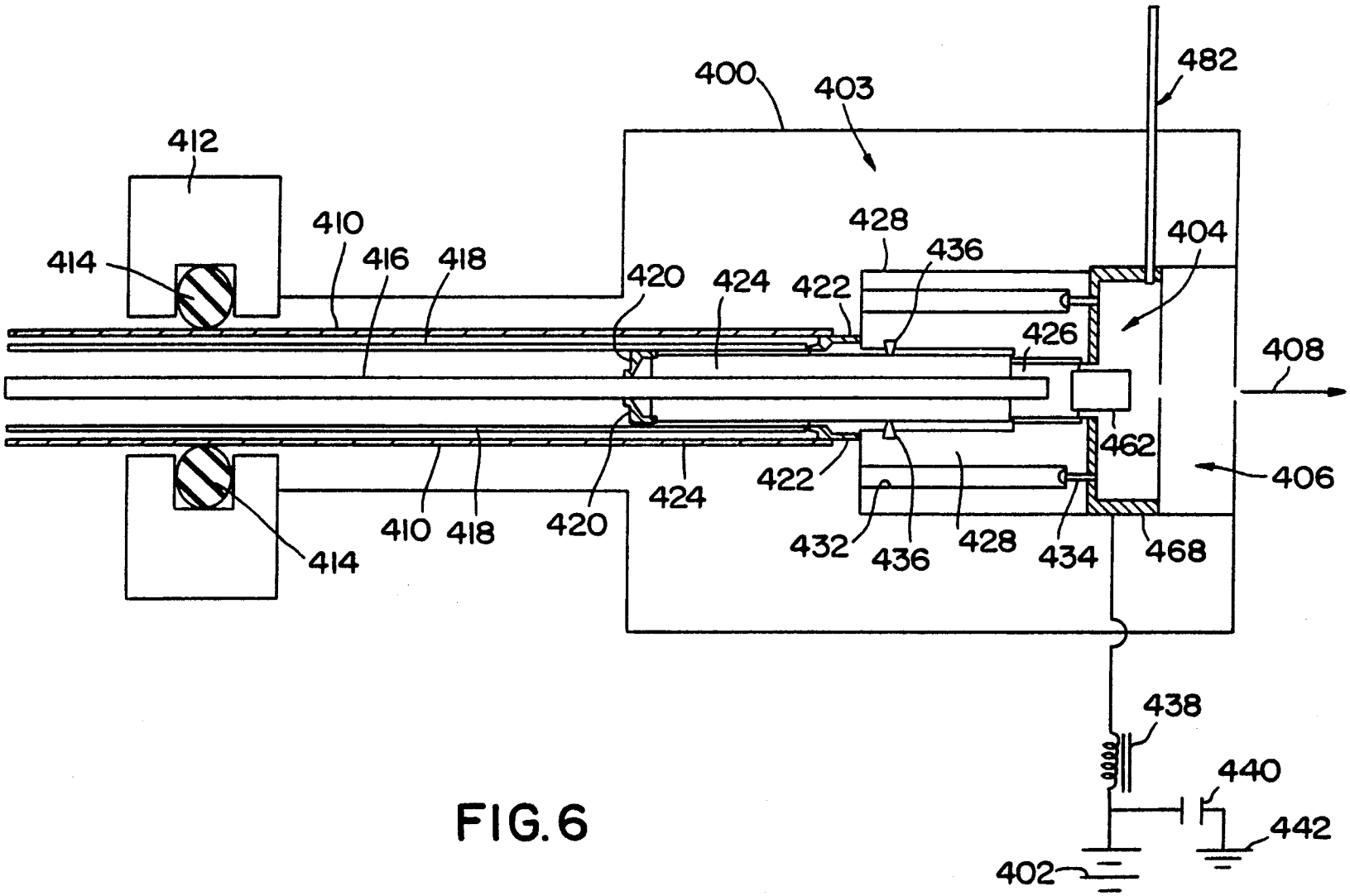
FIG. 6 is a schematic diagram of embodiments of components for use in the preferred embodiment of the present invention shown in FIG. 8.

In accordance with the present invention, FIG. 6 schematically represents another preferred embodiment of an apparatus including an RF probe which is shown inserted into an RF glow discharge cell, wherein the probe and cell have been configured to be used in a conventional VG 9000 TM double-focusing mass spectrometer, also known as a sector mass spectrometer (available from Fisons Instruments, VG Elemental, Winsford, Chesire, ENGLAND). The electrically conducting walls of the RF glow discharge cell are schematically indicated by the cross-hatched enclosure identified by the numeral 468 and define the so-called counterelectrode of the discharge cell. As shown, the probe and cell are housed within a vacuum chamber capable of maintaining a high vacuum on the order of $10^{-7}$ torr within walls schematically represented by the continuous line identified by the numeral 400. The arrow designated by the numeral 403 indicates the high vacuum region maintained within the vacuum chamber 400 surrounding the glow discharge cell 468. The arrow designated by the numeral 404 indicates the region inside the glow discharge cell 468, which region is maintained at a much higher pressure ($\sim 1$ torr), and therefore a relatively lower vacuum, by the introduction of an inert discharge gas (such as argon) through a gas inlet that is schematically indicated by the tube passing through walls 468 and identified by the numeral 482. The region outside the vacuum chamber walls 400 is at atmospheric pressure. The standard lens stack of the mass spectrometer is schematically represented by the rectangular area identified by the numeral 406. The arrow designated by the numeral 408 schematically indicates the ions from the glow discharge that are provided to the mass spectrometer for analysis.

Figure 8:
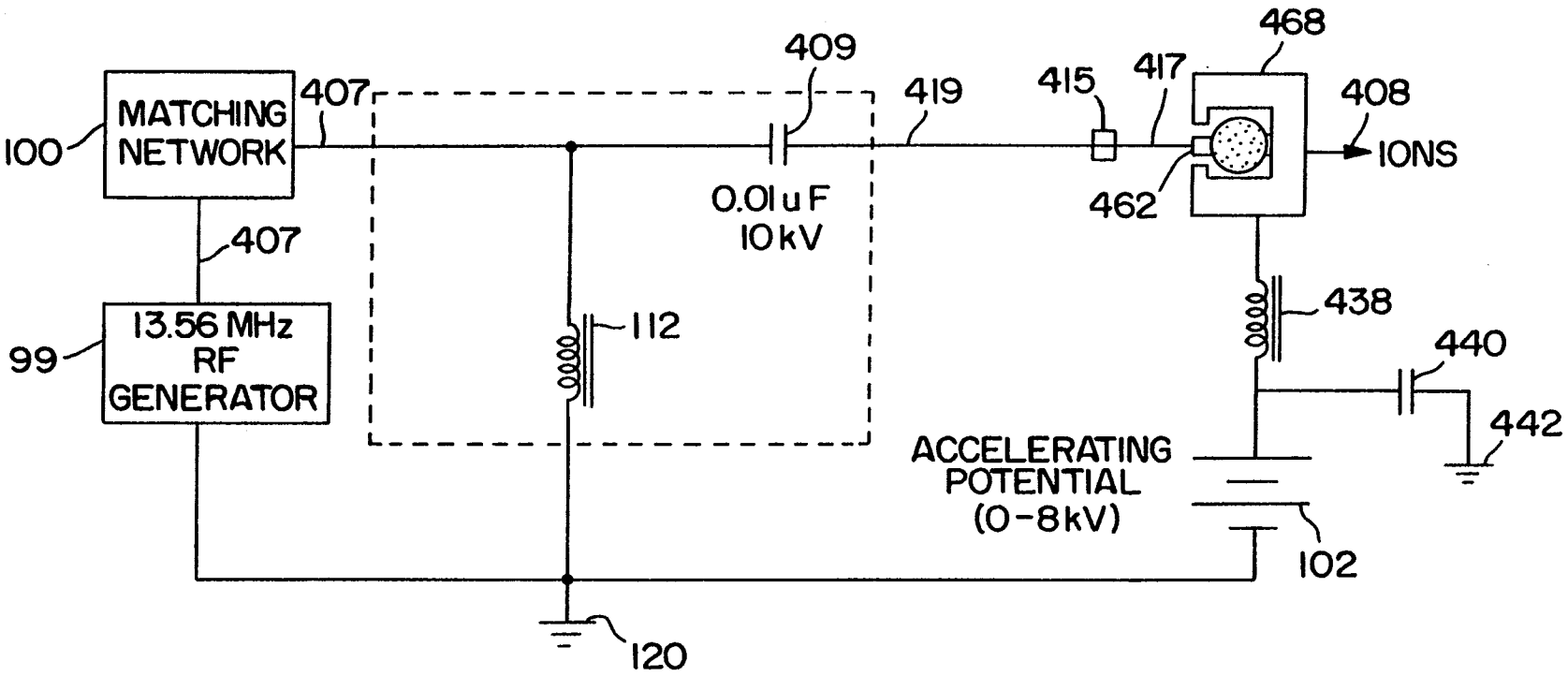
FIG. 8 schematically represents a preferred embodiment of the present invention.

In accordance with the present invention, FIG. 8 schematically presents the overall arrangement for the probe and cell combination shown in FIG. 6. As schematically shown in FIG. 8, an RF power supply 99 provides means for generating a radio frequency electromagnetic potential. RF power supply 99 is electrically connected in series to a matching network 100 via coaxial cable 407 and thence to a $0.01\times10^{-6}$ Farad blocking capacitor 409, which desirably is rated at 10,000 volts. An appropriately rated choke coil 112 is electrically connected in parallel between the blocking capacitor 409 and the matching network 100 and across the RF power supply 99 to a ground connection 120. A type HN connector 415 (though other RF connectors could be used) electrically couples the output of the blocking capacitor 409 in series to the probe 417 via a coaxial cable 419.

The probe provides means for electrically connecting to the sample, the radio frequency electromagnetic potential generated by RF generator 99. By introducing an isolating high voltage capacitance electrically in series between the electrically connecting means of the probe and the impedance matching means of the impedance matching network 100, blocking capacitor 409 provides means for blocking the direct current high voltage between the sample and probe on the one hand and the impedance matching means and RF generating means on the other hand.

As schematically shown in FIG. 6, most of the length of the probe body is defined by a rigid cylindrical wall constructed from electrically conducting material such as stainless steel tubing 410 (o.d.=0.5", i.d.=0.430"). Steel tubing 410 is electrically connected to the coaxial shielding of the coaxial cable 419 (FIG. 8) via connector 415 (FIG. 8) and is electrically grounded to serve as the probe's coaxial shielding of the RF power carried by the probe. Such shielding is required to minimize electrical interference from the RF power.

As shown in FIG. 6, a compression fitting 412 is disposed at the entrance to the high vacuum chamber defined schematically by walls 400 and carries an O-ring 414 configured and disposed to provide a vacuum seal against the outside diameter of steel tubing 410 when the probe is inserted into the high vacuum chamber. An annular aluminum or teflon handle desirably is slipped around the end (not shown) of the probe body disposed opposite from the end carrying the sample 462 to be analyzed. This handle can be secured to steel tubing 410 by a pair of set screws and facilitates operator manipulation of the probe.

As shown in FIG. 6, the RF voltage of ~1 kV is carried by an electrical conductor 416 centrally disposed within the probe. Conductor 416 desirably is formed of a copper rod, but may be formed of another electrically conducting material. A circularly cylindrical insulating sleeve 418 forms an insulating sheath that is interposed between steel tubing 410, which is maintained at ground electrical potential, and center conductor 416 to provide insulation between steel tubing 410 and center conductor 416. Insulating sleeve 418 desirably is formed of material such as Teflon TM or glass such as Pyrex TM with an i.d. of 0.314" and an o.d. of 0.394".

As shown in FIG. 6, the probe includes an electrical feedthrough, which facilitates the transition of the center conductor from the atmospheric pressure and electrically shielded environment of the coaxial cable and the probe body, to the terminal point of a sample holder 426 and a sample 462 exposed to the relatively low pressure interior space defined by the cell walls 468, which are maintained at relatively high voltage. The feedthrough includes a cap 420 formed of electrically conducting material such as 70-30 Cu-Ni, a spacer member 424 formed of electrically insulating material such as $Al_2O_3$ ceramic material, and an adapter 422 formed of electrically conducting material such as metal.

As shown in FIG. 6, a metal-to-metal weld forms a vacuum-tight seal between the interior cylindrical surface of cap 420 and a portion of the exterior cylindrical surface of center conductor 416. Thus, cap 420 will be at the same ~1 kV electrical potential as center conductor 416. Adapter 422 is welded, such as by soft silver-soldering, to form a vacuum-tight seal with the end of steel tubing 410 that is disposed opposite the end connected to the shielding of the coaxial cable (not shown in FIG. 6). Thus, adapter 422 will be at the same ground electrical potential as steel tubing 410 of the probe body.

As schematically shown in FIG. 6, insulator member 424 is configured in an annular shape (o.d. can be 0.280"), and one end of insulator member 424 is connected to cap 420 by a metal-to-ceramic vacuum-tight seal. Annular insulator 424 is configured and disposed to extend into and through adapter 422. Another metal-to-ceramic vacuum-tight seal is formed between the interior cylindrical surface of adapter 422 and the exterior cylindrical surface of insulator member 424. Thus, as center conductor 416 passes through adapter 422, insulator member 424 electrically insulates center conductor 416 (with its RF voltages of ~1 kV) from the ground electrical potential at the steel tubing 410 and adapter 422.

A sample holder 426 is machined from electrically conducting material like copper and is 0.25" in diameter which typically accommodates samples 0.188" in diameter. Sample holders can be machined to accommodate a range of sample sizes. Sample holder 426 either snug fits over the free end of center conductor 416 or is secured with a set screw (not shown). The sample 462 to be analyzed can be a conducting or nonconducting solid.

In accordance with the present invention, a means is provided for disposing the sample relative to the counterelectrode such that application of a predetermined radio frequency electrical potential between the sample and the counterelectrode in the presence of an inert gas inside the vacuum chamber forms a sustainable glow discharge. As embodied herein and schematically shown in FIG. 6 for example, the disposing means includes a cell assembly that includes an insulator member 428 and a discharge cell defined by electrically conducting walls 468. The cell walls 468 are constructed from an electrically conducting material such as steel and form a cell having dimensions of 0.748" i.d., 1.07" o.d., and 0.615" height. Insulator member 428 desirably is constructed from boron nitride and has a 1.07" o.d. and 0.35" i.d. at the probe insertion point, but may be configured to accommodate a range of sample sizes. Screw holes 432 allow screws 434 (#2-56) to be inserted through the length of the boron nitride insulator member 428. The screws 434 connect the boron nitride insulator member 428 to steel walls 468 of the discharge cell. Boron nitride insulator member 428 provides electrical insulation between the steel walls 468 of the cell, which are maintained at a high direct current voltage (~1 to 10 kV), which is schematically indicated by the symbol labelled 102 in FIGS. 6 and 8, and the probe's stainless steel tubing 410 and adapter 422, which are maintained at ground electrical potential.

The discharge cell houses the glow discharge which is maintained on the surface of sample 462. As shown schematically in FIG. 6, the probe is inserted into insulator member 428 so that sample 462 becomes exposed to the counterelectrode formed by discharge cell walls 468. The inside diameter of boron nitride insulator 428 may be configured as required to accommodate a particular sample size. In the embodiment under discussion, the inside diameter of boron nitride insulator 428 reduces successively to 0.26" to accommodate the 0.25" o.d. sample holder 426 and thence to 0.20" to accommodate the 0.188" o.d. sample 462, respectively. In so doing, insulator member 428 is configured to position sample holder 426 and sample 462 closer to insulator member 428 than the discharge dark space region, thereby reducing the likelihood of forming a discharge in the regions between insulator 428 and holder 426 or sample 462. The glow discharge is confined by the steel cell's orifice (diameter=0.216" for 0.188" diameter samples) which is positioned within one dark space of the surface of sample 462.

Moreover, as shown in FIG. 6, the disposing means can include an O-ring 436 carried by the 0.35 i.d. portion of insulator member 428. When the probe is inserted into the cell assembly, ceramic insulator 424 is positioned in vacuum-sealing engagement with O-ring 436 carried by insulator member 428. In this application, O-ring 436 is a Viton TM O-ring which forms a vacuum-tight seal with the ceramic material forming insulator 424. This is necessary because the source assembly is housed in a high vacuum ($\sim 1.0\times 10^{-7}$ torr) region 403, which is within the enclosure schematically indicated by 400, while the discharge which is maintained inside the cell with steel walls 468 is at a much higher pressure ($\sim 1$ tort) because of the discharge gas being introduced through gas inlet 482. Thus, the O-ring 436-to-ceramic 424 seal maintains the differential pressure region. As explained in U.S. Pat. Nos. 5,006,706 and 5,086,226 to Marcus, sampling for mass spectrometric analysis is highly region-specific, and positioning of the negative glow/dark space interface at the sampling cone, is sensitive to adjustments of both pressure and power. In addition, the boron nitride insulator member 428 also provides high thermal conductivity for the standard VG9000 TM cold finger (liquid nitrogen temperature) attachment (not shown).

In addition, insulator member 428 is configured and O-ring 436 is configured and disposed so that no components maintained at ground electrical potential, can become disposed so as to bridge within both the higher pressure region (extending between O-ring 436 and within cell walls 468) and the lower pressure region (extending between O-ring 436 and within the surrounding vacuum chamber walls 400). Accordingly, since adapter 422 is the forward-most probe component maintained at ground electrical potential, the probe and cell are configured in accordance with the embodiment of the present invention shown in FIG. 6, so that adapter 422 does not extend past O-ring 436 and thus does not bridge between the lower pressure region (extending between O-ring 436 and within the surrounding vacuum chamber walls 400) and the higher pressure region that extends from O-ring 436 and into the discharge cell where the argon gas is introduced. Furthermore, the length of insulator member 428 must be long enough to provide adequate electrical insulation against arcing between adapter 422 at ground potential and cell walls 468 at a high electrical voltage on the order of 8 to 10 kilovolts. Typically, about one half inch of boron nitride between the heads of screws 434 and adapter 422, suffices for this purpose of providing adequate electrical insulation.

As shown in FIGS. 6 and 8, a $40\times 10^{-6}$ Henry choke coil 438 is electrically connected in series between cell walls 468 and the source 102 of the direct current accelerating potential used to remove ions from the glow discharge and provide these ions to be analyzed by the mass spectrometer. In addition a $200\times 10^{-12}$ Farad capacitor 440 has one end electrically connected between choke coil 438 and power source 102 and the other end electrically connected to ground 442. This additional coil 438 and capacitor 440 aids in isolating the accelerating potential 102 from the RF power source 99.

In a further embodiment of an apparatus and method according to the present invention, an RF powered glow discharge atomization/excitation source incorporating an external sample mount geometry as described in U.S. Pat. No. 5,086,226 to Marcus, is illustrated schematically in FIG. 7 and designated generally by the numeral 40. In accordance with the present invention, glow discharge source 40 can be used in conjunction with a conventional mass spectrometer by disposing the source 40 within a high vacuum enclosure such as enclosure 400 shown in FIG. 6 for example. The chamber body 68 of the source 40 desirably can be configured with ports such as shown in FIG. 5B for example. Such body 68 forms an enclosure that defines a vacuum chamber and is desirably formed of stainless steel. The stainless steel walls forming the interior surface of the vacuum chamber also define a counterelectrode surface area exposed to the interior of the vacuum chamber.

The enclosure further defines a sample port that communicates between the interior and the exterior of the vacuum chamber. As embodied herein and shown schematically in FIG. 7 for example, the sample port is an opening 76 defined in chamber body 68. An inert gas such as argon can enter the discharge chamber defined by chamber body 68 through one or both of two 0.63 cm diameter circular compression fittings 82 defining gas inlet ports for the introduction of the inert gas. Defined in the top of the chamber is a vacuum port 84 which leads to an adjustable-flow (bellows) vacuum valve (not shown) that controls the degree of vacuum present within the discharge chamber defined by chamber body 68.

Figure 7:
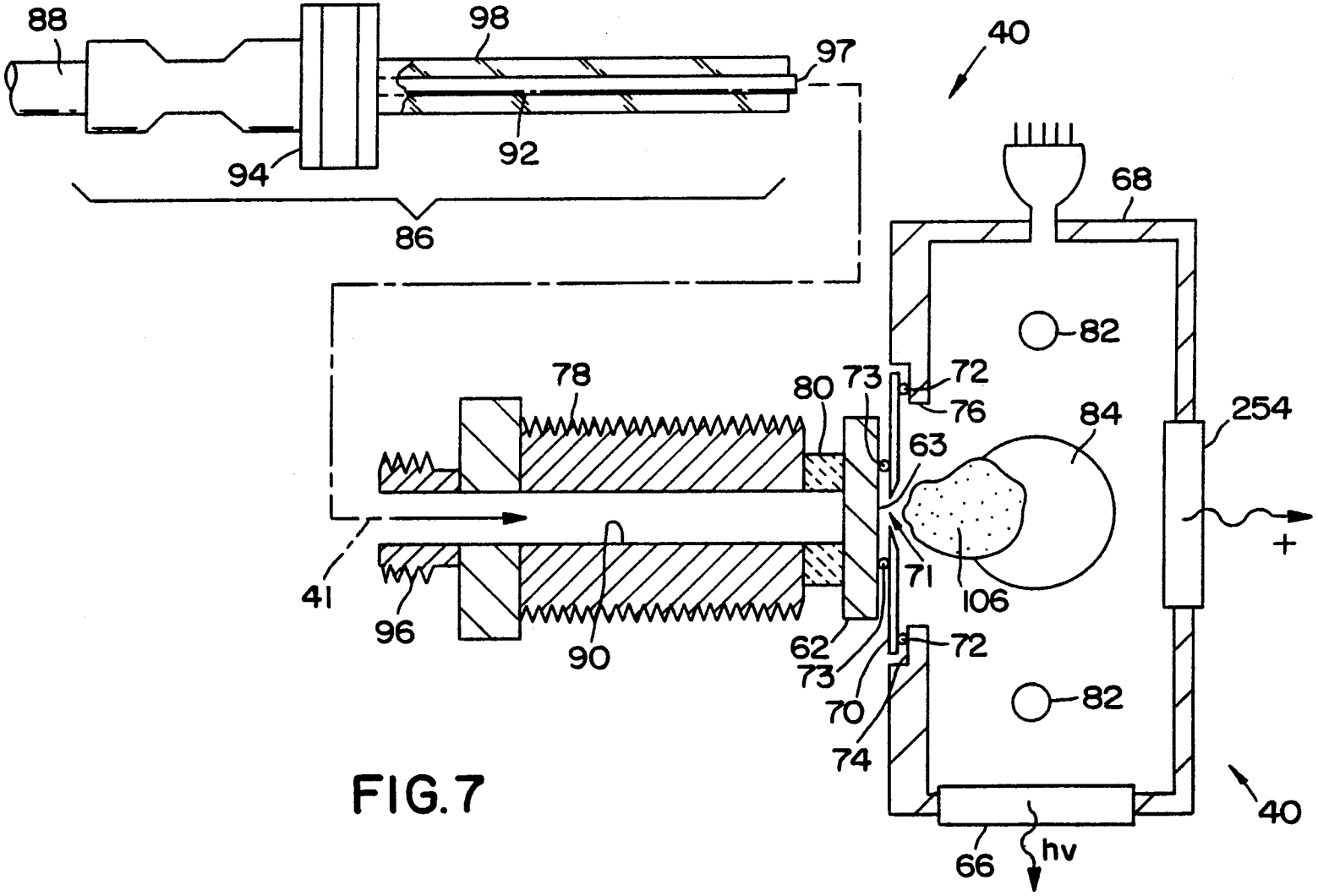
FIG. 7 is a schematic representation of components of an embodiment of the present invention.

In further accordance with the present invention, a means is provided for disposing the sample relative to the counterelectrode such that application of a predetermined radio frequency electrical potential between the sample and the counterelectrode in the presence of an inert gas inside the vacuum chamber forms a sustainable glow discharge. As schematically shown in FIG. 7 for example, one embodiment of the disposing means includes an external mount for receiving a solid sample external to the vacuum chamber. The external mount can include a lip flange surface 74, which generally is defined in stainless steel body 68 and is oriented to face away from the interior of the chamber. Lip flange surface 74 forms part of the exterior surface of the chamber and frames sample port opening 76. Since lip flange surface 74 is defined in stainless steel body 68, the external mount is electrically connected to the stainless steel walls defining the counterelectrode surface area exposed to the interior of the vacuum chamber.

As embodied herein and shown schematically in FIG. 7 for example, the external mount can include an external mounting plate in the form of an orifice disk 70. The external mounting plate is electrically connected, as by metal screws for example, to enclosure body 68. Moreover, the external mounting plate defines a sample hole in the form of an orifice 71 that is circumscribed by sample port 76 and so controls the exposure of surface 63 of sample 62 to negative glow 106. Orifice 71 defined in orifice disk 70 desirably can have a circular shape with a diameter on the order of about two to twelve millimeters. An orifice of 2 mm provides a higher power density, which is desirable to enhance emission intensity. At some point, the orifice becomes too small to be able to accommodate dark spaces. With a 2 mm diameter orifice, a chamber pressure of from about 4 or 5 torr and above, must be maintained. Otherwise, a dark space cannot fit inside the orifice, and consequently no discharge will occur.

A conformable mounting plate sealing gasket in the form of an O-ring 72 is desirably disposed between the interior surface of the periphery of orifice disk 70 and lip flange surface 74 formed around sample port opening 76. The central opening defined in O-ring 72 is large enough to surround sample port opening 76. Moreover, the O-ring gasket is able to conform its shape sufficiently under the application of pressure so that a vacuum tight seal is formed between the mounting plate and the exterior of the vacuum chamber enclosure. The O-ring 72 is desirably formed of a rubber soft enough to ensure an excellent seal under vacuum conditions.

In yet further accordance with the apparatus of the present invention, a torque bolt can be provided to bias and secure the sample so as to expose a surface of the sample to the interior of the vacuum chamber. As embodied herein and shown schematically in FIG. 7 for example, a brass torque bolt 78 is disposed outside the vacuum chamber defined by the enclosure. In order to electrically insulate the brass bolt from the sample, a ceramic spacer 80 is desirably disposed between the bolt and the sample 62.

In still further accordance with the present invention, means are provided to furnish a vacuum tight seal and maintain a less than one dark space separation between the surface forming the vacuum chamber electrode and a surface of the sample exposed to the interior of the vacuum chamber when the sample is secured to the external mount of the enclosure. As embodied herein and shown in FIG. 7 for example, a conformable sample sealing gasket in the form of an O-ring 73 is configured so as to be disposable against and between a first surface and a second surface so as to provide a vacuum tight seal and maintain a less than one dark space separation between the first surface and the second surface when the torque bolt secures the sample against the sample sealing gasket. Desirably, O-ring 73 is disposed between the exterior surface of orifice disk 70 and surface 63 of sample 62. Accordingly, a separation distance of less than one dark space is maintained between the first surface, which is the sample's surface 63 facing toward the interior of the vacuum chamber, and the second surface, which is the mounting plate surface facing away from the interior of the vacuum chamber, when torque bolt 78 secures sample 62 against sample sealing gasket 73. A suitable gasket for O-ring 73 is formed of TEFLON TM for example because of higher heat resistant properties of this material than rubber. Pressure is applied to form a vacuum-tight seal between sample 62 and orifice disk 70 and between orifice disk 70 and lip 74 of chamber body 68 by rotation of threaded brass torque bolt 78 against the insulating compression ring formed as spacer 80. Insulating spacer 80 also functions to prevent bolt 78 from damaging the sample when the bolt is tightened to secure the sample to the external mount.

In some embodiments of the sample securing and dark space maintaining means, the mounting plate, such as orifice disk 70, can be formed as a unitary part of enclosure body 68. However, such embodiments would forego the advantages of the interchangeability of mounting plates with differently sized and/or shaped orifices.

In still other embodiments of the sample securing and dark space maintaining means, a sample holder is provided in the form of a mold in which powdered sample material can be compacted and held. The external mounting plate 70 and the flexible gaskets 72 and 73 provide means for disposing the sample relative to the counterelectrode 68 such that application of a predetermined radio frequency electrical potential between sample 62 and counterelectrode 68 in the presence of an inert gas inside the vacuum chamber forms a sustainable glow discharge.

In still further accordance with the apparatus of the present invention, means are provided for applying a radio frequency electromagnetic potential between the counterelectrode, which is exposed to the interior of the vacuum chamber, and the sample to be received by the external mount. As embodied herein and shown schematically in FIG. 7 for example, an RF feedthrough 86 can be electrically attached to the end of a coaxial RF power cable (RG 213/U) 88, which can be inserted into an elongated cavity 90 defined longitudinally through bolt 78 and spacer 80. For example, one end of power cable 88 can be connected to an elongated copper conductor rod 92 via a male type-N coaxial connector 94, wherein the free end of conductor rod 92 can be configured as an electrical terminal 97 with a circular transverse cross-sectional diameter of 3.2 millimeters. A female coaxial connector 96 can be defined at the end of bolt 78 opposite the end of bolt 78 disposed to press against spacer 80. When male connector 94 is mated to female coaxial connector 96, the terminal 97 of conductor rod 92 makes contact with the back of sample 62. Then the RF generator provides the means for applying a radio frequency electromagnetic potential between the counterelectrode 68 and electrical terminal 97. A circular cylindrical annular glass insulator member 98 can serve as an electrically insulating sheath that surrounds conductor rod 92 and effectively prevents arcing between conductor rod 92 and bolt 78. In this way, the conductor rod 92 carrying the RF power to the sample 62, desirably is coaxially shielded completely by bolt 78 excepting only the conductor's terminal point of contact with the sample 62. Thus, in accordance with the present invention, the conductors carrying the RF power to the sample are completely electrically shielded downstream of the sample and thereby avoid the problems associated with an arrangement such as shown in FIG. 2 of U.S. Pat. No. 4,853,539 to Hall et al with its unshielded contact spring 27.

What is claimed is:

1. An apparatus for using radio frequency electromagnetic energy to form a glow discharge from a solid sample for use in a mass spectrometer, whether the sample is electrically conducting or nonconducting, and whether the sample is machineable or nonmachineable, the apparatus comprising:

(a) an enclosure,
  i) said enclosure defining a vacuum chamber,
  ii) said enclosure defining an electrically conducting counterelectrode having a surface exposed to the interior of said vacuum chamber;

(b) means for disposing the sample relative to said counterelectrode such that application of a predetermined radio frequency electrical potential between the sample and said counterelectrode in the presence of an inert gas inside said vacuum chamber forms a sustainable glow discharge;

(c) means for generating a radio frequency electromagnetic potential;

(d) means for electrically connecting to the sample the radio frequency electromagnetic potential generated by said generating means;

(e) means for applying a preselected high direct current voltage to said counterelectrode to aid in providing ions from the glow discharge for subsequent analysis;

(f) means for matching the impedance of said generating means and a combination of said connecting means, said counterelectrode, the sample disposed by said disposing means, said disposing means, and the glow discharge, said impedance matching means being electrically connected in series between said electrically connecting means and said generating means; and (g) means for blocking direct current flow between said electrically connecting means and said impedance matching means due to said preselected high direct current voltage.

2. An apparatus as in claim 1, wherein said sample disposing means includes:

i) an annular insulating member configured and disposed with one end connected to said enclosure and defining an elongated opening therethrough; and ii) a vacuum sealing O-ring configured and disposed about said elongated opening in the vicinity of the end of said annular insulating member opposite said one end connected to said enclosure.

3. An apparatus for using radio frequency electromagnetic energy to form a glow discharge from a solid sample for use in a mass spectrometer, whether the sample is electrically conducting or nonconducting, and whether the sample is machineable or nonmachineable, the apparatus comprising:

(a) an enclosure, i) said enclosure defining a vacuum chamber, ii) said enclosure defining an electrically conducting counterelectrode having a surface exposed to the interior of said vacuum chamber;

(b) means for disposing the sample relative to said counterelectrode such that application of a predetermined radio frequency electrical potential between the sample and said counterelectrode in the presence of an inert gas inside said vacuum chamber forms a sustainable glow discharge;

(c) means for generating a radio frequency electromagnetic potential;

(d) means for electrically connecting to the sample the radio frequency electromagnetic potential generated by said generating means;

(e) means for applying a preselected high direct current voltage to said counterelectrode to aid in providing ions from the glow discharge for subsequent analysis;

(f) means for matching the impedance of said generating means and said combination of said connecting means, said counterelectrode, the sample disposed by said disposing means, said disposing means, and the glow discharge, said impedance matching means being electrically connected in series between said electrically connecting means and said generating means; and (g) mean for blocking direct current flow between said electrically connecting means and said impedance matching means, wherein said connecting means comprises:

i) a first coaxial connector configured to be electrically connected to one end of a radio frequency coaxial cable, ii) an elongated conductor having a first end and a second end disposed opposite said first end, said first end of said conductor being electrically connected to said first coaxial connector, iii) an electrically conducting sample holder member having one end configured to receive a sample therein and having an opposite end electrically connected to said second end of said conductor, iv) an annular insulator member configured and disposed to surround a predetermined length of said conductor extending from said sample holder member toward said first end of said conductor, v) an adapter member configured and disposed to form a vacuum-tight seal with the exterior surface of an intermediate circumferential portion of said insulator member, vi) an electrically conducing probe body configured and disposed to surround said conductor and extending between and electrically connecting said first coaxial connector and said adapter member, vii) an electrically insulating sleeve configured and disposed to surround said conductor and said insulator member and extending between said first coaxial connecter and said adapter member and disposed between said probe body and said annular insulator member, and viii) an annular cap member configured and disposed with one end forming a vacuum-tight seal with the end of said insulator member disposed farther away from said sample holder member, said annular cap member having a second end configured and disposed to form a vacuum-tight seal with said conductor.

4. An apparatus as in claim 3, wherein said sample disposing means includes:

an annular insulating member configured and disposed with one end connected to said enclosure and defining an elongated opening therethrough; and ii) a vacuum sealing O-ring configured and disposed about said elongated opening in the vicinity of the end of said annular insulating member opposite said one end connected to said enclosure and further configured to form a vacuum-tight seal against said insulator member when said insulator member is inserted into said elongated opening; and iii) wherein said elongated opening is configured so that when the sample is disposed inside said enclosure to sustain a glow discharge on the surface of the sample exposed to said counterelectrode, said O-ring is disposed between said adapter and said sample holder member.

5. An apparatus as in claim 1, wherein said electrically connecting means comprises:

i) a radio frequency coaxial cable, ii) a first coaxial connector electrically connected to one end of said radio frequency coaxial cable, iii) an elongated conductor having a first end and a second end disposed opposite said first end, said first end of said conductor being electrically connected to said first coaxial connector, iv) a second coaxial connector disposed so that upon engaging said first coaxial connector said second end of said conductor electrically engages the sample during operation of the apparatus, v) an electrically insulating sheath surrounding said conductor between said first and second ends of said conductor, and an electrically conducting shield surrounding said conductor upstream of where said terminal contacts the sample.

6. An apparatus as in claim 1, wherein said sample disposing means includes an external mounting plate and a flexible gasket for sealing the sample against said mounting plate.

7. An apparatus as in claim 1, further comprising:

(h) an inductive impedance electrically connected as a choke coil to protect said impedance matching means and said radio frequency electromagnetic potential generating means against electronic shorting of said direct current flow blocking means.

8. An apparatus as in claim 1, further comprising:

(h) an inductive impedance electrically connected in series between said counterelectrode and said means for applying a preselected high direct current voltage to said counterelectrode.

9. An apparatus as in claim 8, further comprising:

(i) a capacitive impedance electrically connected in parallel between said inductive impedance and said means for applying a preselected high direct current voltage to said counterelectrode.

10. An apparatus as in claim 1, wherein said high direct current voltage applying means includes a direct current transformer.

11. An apparatus as in claim 1, wherein said radio frequency electromagnetic potential generating means includes a radio frequency generator capable of generating at least 300 volts at a frequency of at least one megahertz.

12. An apparatus as in claim 1, wherein said direct current blocking means includes an isolating high voltage capacitance electrically connected in series between said electrically connecting means and said impedance matching means.

13. An apparatus as in claim 1, wherein said impedance matching means includes a high voltage capacitor electrically connected in series with said radio frequency electromagnetic electric potential generating means.

14. An apparatus as in claim 1, wherein said means for generating a radio frequency electromagnetic potential includes means for electrically shielding the generated radio frequency electromagnetic potential.

15. An apparatus as in claim 14, wherein said means for electrically shielding the generated radio frequency electromagnetic potential, comprises:

i) a cylindrically configured electrically conducting shield surrounding said electrically connecting means upstream of where said electrically connecting means electrically connects the radio frequency electromagnetic potential to the sample.

16. An apparatus as in claim 1, further comprising:

i) a mass spectrometer configured and disposed for receiving matter removed from the glow discharge for subsequent analysis.

17. A method for using radio frequency electromagnetic energy to transform a solid sample, whether the sample is electrically conducting or nonconducting, into a glow discharge source and analyzing the sample with a mass spectrometer, the method comprising the steps of:

(a) enclosing an inert gas within a vacuum chamber defining a counterelectrode having a surface exposed to the interior of said vacuum chamber;

(b) disposing the sample relative to said counterelectrode such that application of a predetermined radio frequency electrical potential between said sample and said counterelectrode in the presence of said inert gas inside said vacuum chamber forms a sustainable glow discharge;

(c) electrically connecting the sample in series to an isolating high voltage capacitance;

(d) electrically connecting in series said isolating high voltage capacitance to a capacitive impedance matching network;

(e) electrically connecting in series to said capacitive impedance matching network, means for generating a radio frequency electromagnetic potential;

(f) applying a radio frequency electromagnetic potential between said counterelectrode and said sample via said isolating high voltage capacitance; and (g) applying a preselected high direct current voltage to said counterelectrode to accelerate ions from said vacuum chamber to a mass spectrometer for analysis.

18. A method as in claim 17, further comprising the step of:

(a) electrically connecting an inductance between said capacitive impedance matching network and said isolating high voltage capacitance and between said means for generating a radio frequency electromagnetic potential and said counterelectrode.

19. A method as in claim 17, further comprising the steps of:

(a) enclosing said vacuum chamber inside a higher vacuum enclosure;

(b) maintaining at electrical ground potential, said impedance matching network and said means for generating a radio frequency electromagnetic potential; and (c) preventing components maintained at ground electrical potential from bridging between said vacuum chamber and said higher vacuum enclosure.

* * * * *